US007267610B1

(12) United States Patent
Elmufdi et al.

(10) Patent No.: US 7,267,610 B1
(45) Date of Patent: Sep. 11, 2007

(54) CMP PAD HAVING UNEVENLY SPACED GROOVES

(75) Inventors: Carolina L. Elmufdi, Glen Mills, PA (US); Gregory P. Muldowney, Earleville, MD (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 0 days.

(21) Appl. No.: 11/512,994

(22) Filed: Aug. 30, 2006

(51) Int. Cl.
*B24D 11/00* (2006.01)

(52) U.S. Cl. ..... 451/530; 451/527

(58) Field of Classification Search ..... 451/526–539, 451/548–551
See application file for complete search history.

(56) References Cited

U.S. PATENT DOCUMENTS 5,020,283 A 6/1991 Tuttle
5,177,908 A 1/1993 Tuttle
5,441,598 A 8/1995 Yu et al.
5,984,769 A 11/1999 Bennett et al.
6,093,651 A 7/2000 Andideh et al.
6,165,904 A 12/2000 Kim
6,238,271 B1 * 5/2001 Cesna ..... 451/41
6,500,054 B1 12/2002 Ma et al.
6,648,743 B1 * 11/2003 Burke ..... 451/526
6,729,950 B2 * 5/2004 Park et al. ..... 451/528
6,783,438 B2 8/2004 Muldowney
6,843,711 B1 * 1/2005 Muldowney ..... 451/527
6,951,506 B2 * 10/2005 Andideh et al. ..... 451/41
6,951,510 B1 * 10/2005 Rodriguez et al. ..... 451/56
2005/0202761 A1 9/2005 Rodriguez et al.

* cited by examiner

*Primary Examiner*—Dung Van Nguyen
(74) *Attorney, Agent, or Firm*—Blake T. Biederman

(57) ABSTRACT

A chemical mechanical polishing pad (100) having a circular polishing track (124) and a concentric center (116). The polishing pad (100) includes a polishing layer (104) having a groove pattern containing a plurality of grooves (128) each extending through the polishing track (124). The plurality of grooves have an angular pitch that varies in a circumferential direction about the concentric center (116) of the pad (100) and the radial pitch between all adjacent grooves (128) within the wafer track (124) is unequal.

9 Claims, 9 Drawing Sheets

CMP PAD HAVING UNEVENLY SPACED GROOVES

BACKGROUND OF THE INVENTION

The present invention generally relates to the field of chemical mechanical polishing (CMP). In particular, the present invention is directed to a CMP pad having unevenly spaced grooves.

In the fabrication of integrated circuits and other electronic devices on a semiconductor wafer, multiple layers of conducting, semiconducting and dielectric materials are deposited onto and etched from the wafer. Thin layers of these materials may be deposited by a number of deposition techniques. Common deposition techniques in modern wafer processing include physical vapor deposition (PVD) (also known as sputtering), chemical vapor deposition (CVD), plasma-enhanced chemical vapor deposition (PECVD) and electrochemical plating. Common etching techniques include wet and dry isotropic and anisotropic etching, among others.

As layers of materials are sequentially deposited and etched, the surface of the wafer becomes non-planar. Because subsequent semiconductor processing (e.g., photolithography) requires the wafer to have a flat surface, the wafer needs to be periodically planarized. Planarization is useful for removing undesired surface topography as well as surface defects, such as rough surfaces, agglomerated materials, crystal lattice damage, scratches and contaminated layers or materials.

Chemical mechanical planarization, or chemical mechanical polishing (CMP), is a common technique used to planarize semiconductor wafers and other workpieces. In conventional CMP using a dual-axis rotary polisher, a wafer carrier, or polishing head, is mounted on a carrier assembly. The polishing head holds the wafer and positions it in contact with a polishing layer of a polishing pad within the polisher. The polishing pad has a diameter greater than twice the diameter of the wafer being planarized. During polishing, the polishing pad and wafer are rotated about their respective concentric centers while the wafer is engaged with the polishing layer. The rotational axis of the wafer is offset relative to the rotational axis of the polishing pad by a distance greater than the radius of the wafer such that the rotation of the pad sweeps out an annular "wafer track" on the polishing layer of the pad. When the only movement of the wafer is rotational, the width of the wafer track is equal to the diameter of the wafer. However, in some dual-axis polishers the wafer is oscillated in a plane perpendicular to its axis of rotation. In this case, the width of the wafer track is wider than the diameter of the wafer by an amount that accounts for the displacement due to the oscillation. The carrier assembly provides a controllable pressure between the wafer and polishing pad. During polishing, a slurry, or other polishing medium, is flowed onto the polishing pad and into the gap between the wafer and polishing layer. The wafer surface is polished and made planar by chemical and mechanical action of the polishing layer and polishing medium on the surface.

The interaction among polishing layers, polishing media and wafer surfaces during CMP is being increasingly studied in an effort to optimize polishing pad designs. Most of the polishing pad developments over the years have been empirical in nature. Much of the design of polishing surfaces, or layers, has focused on providing these layers with various patterns of voids and arrangements of grooves that are claimed to enhance slurry utilization and polishing uniformity. Over the years, quite a few different groove and void patterns and arrangements have been implemented. Prior art groove patterns include radial, concentric circular, Cartesian grid and spiral, among others. Prior art groove configurations include configurations wherein the width and depth of all the grooves are uniform among all grooves and configurations wherein the width or depth of the grooves varies from one groove to another.

More particularly, a number of prior art groove patterns for rotational polishing pads involve grooves that extend from a location near or at the concentric centers of the pads to a location near or at the outer periphery of the pad. Examples of such patterns in the context of radial grooves and spiral grooves appear in U.S. Pat. No. 6,783,436 to Muldowney. All of the radial and spiral groove patterns disclosed in the Muldowney patent have a constant angular pitch in direction around the respective pads, as is typical of such groove patterns. The Muldowney patent also shows polishing pads having Cartesian grid and concentric circle groove patterns. The grooves in both of these patterns have a constant pitch, i.e., the spacing of adjacent grooves is the same. U.S. Pat. No. 5,984,769 to Bennett et al. discloses in one instance a polishing pad having concentric circular grooves arranged such that the pitch of the grooves is changed depending upon where the grooves are located on the pad. In another instance, the Bennett et al. patent discloses a polishing pad in which the pitch between adjacent segments of a single spiral groove varies depending on where the grooves are located on the pad.

While the prior art contains polishing pads having a wide variety of groove patterns, the effectiveness of these grooves patterns varies from one pattern to another, as well as from polishing process to polishing process. Polishing pad designers are continually seeking groove patterns that that make the polishing pads more effective and useful relative to prior art pads.

STATEMENT OF THE INVENTION

In one aspect of the invention, a polishing pad comprises a polishing layer configured for polishing at least one of a magnetic, optical and semiconductor substrate in the presence of a polishing medium, the polishing layer including a polishing surface having a concentric center, a wafer track defined thereon during polishing of a wafer and an outer periphery, the wafer track having an inner boundary and an outer boundary spaced from the inner boundary; a plurality of grooves located in the polishing surface, each groove of the plurality of grooves extending through the wafer track so as to cross each of the inner boundary and the outer boundary, the plurality of grooves having an angular pitch that varies in a predetermined manner where radial pitch between grooves measured in a radial direction from the concentric center to the outer periphery is unequal for all adjacent grooves within the wafer track; and a plurality of groove sets in the wafer track, each of the plurality of groove sets being formed by the plurality of grooves.

In another aspect of the invention, a polishing pad comprises a polishing layer configured for polishing at least one of a magnetic, optical and semiconductor substrate in the presence of a polishing medium, the polishing layer including a polishing surface having a concentric center, a wafer track defined thereon during polishing of a wafer and an outer periphery, the wafer track having an inner boundary and an outer boundary spaced from the inner boundary; a plurality of grooves located in the polishing surface, each groove of the plurality of grooves extending through the wafer track so as to cross each of the inner boundary and the outer boundary, the plurality of grooves having an angular pitch that varies in a predetermined manner where radial pitch between grooves measured in a radial direction from the concentric center to the outer periphery is unequal for all adjacent grooves within the wafer track; and a plurality of groove sets in the wafer track, each of the plurality of groove sets being formed by at least three grooves and the wafer track includes at least three groove sets.

DETAILED DESCRIPTION OF THE INVENTION

Figure 1:
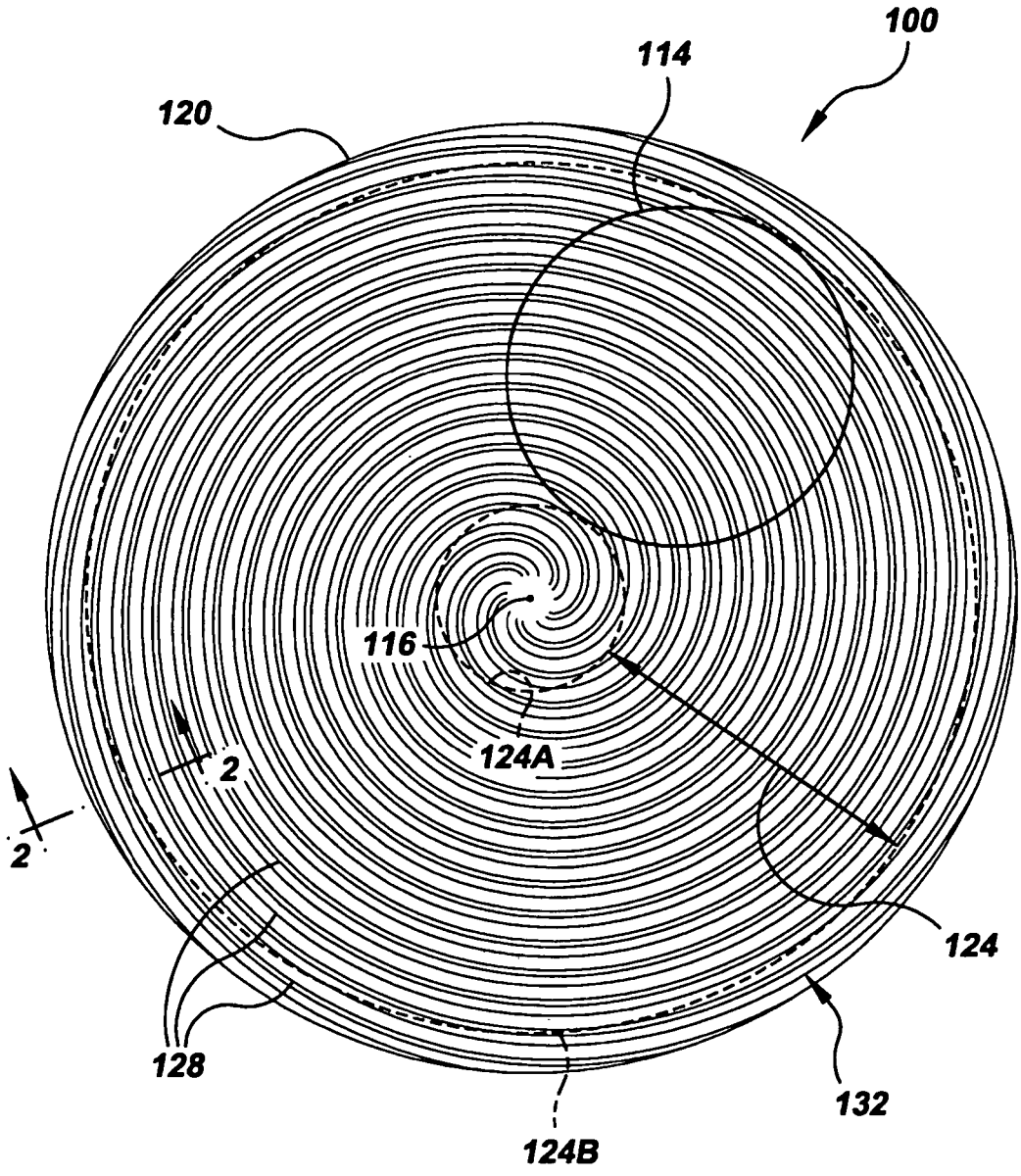
FIG. 1 is a plan view of a polishing pad made in accordance with the present invention.
Figure 2:
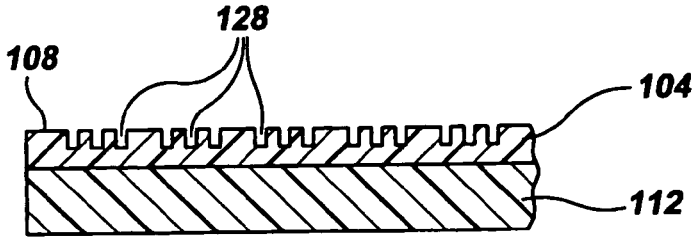
FIG. 2 is an enlarged cross-sectional view of the polishing pad of FIG. 1 as taken along line 2-2 of FIG. 1.
Figure 3:
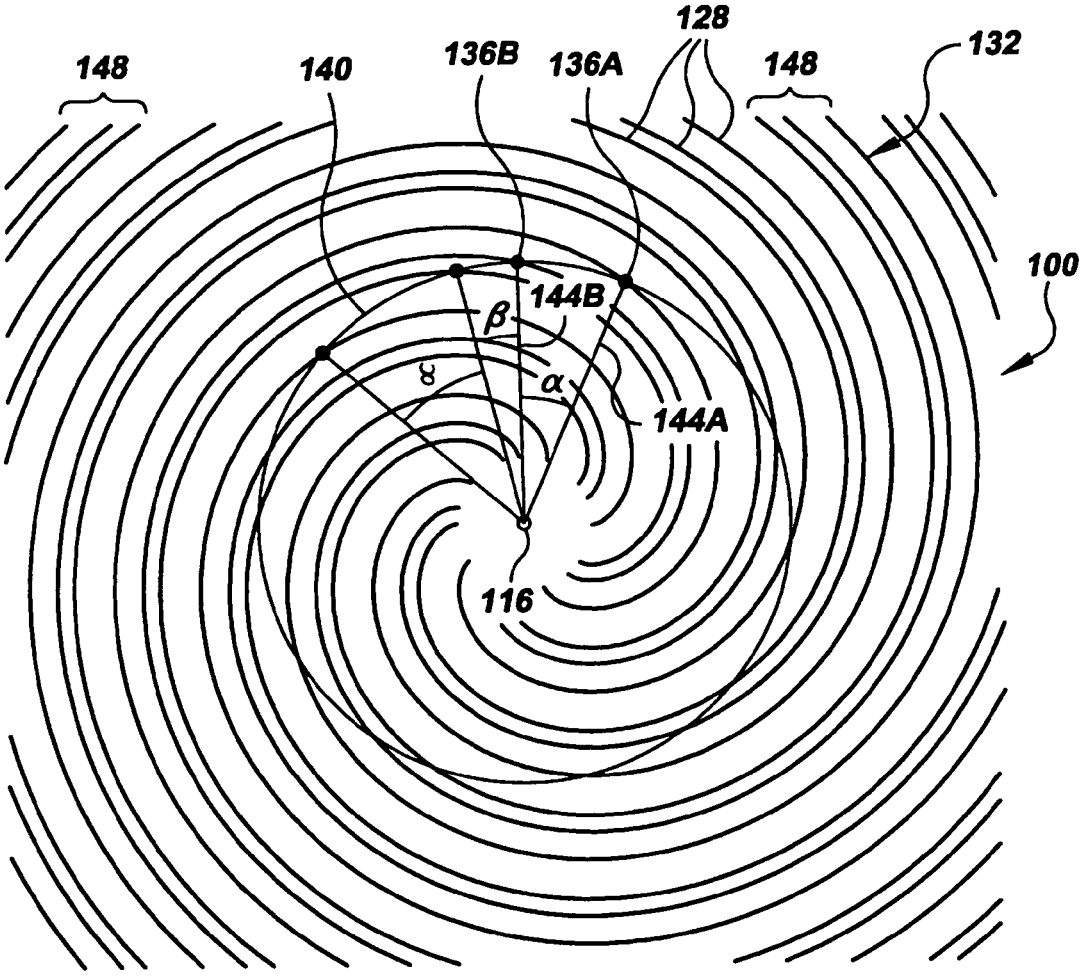
FIG. 3 is an enlarged plan view of the polishing pad of FIG. 1 showing a central portion of the pad.

Referring to the drawings, FIGS. 1-3 illustrate a polishing pad 100 made in accordance with the present invention that, as described below in more detail, may be used with a CMP polishing machine. As seen in FIG. 2, polishing pad 100 includes a polishing layer 104 having a polishing surface 108. Polishing layer 104 may be supported by a backing layer 112, which may be formed integrally with the polishing layer or may be formed separately from the polishing layer. Polishing layer 104 may be made out of any material suitable for polishing the article being polished, such as a semiconductor wafer 114 (shown), magnetic media article, e.g., a disk of a computer hard drive or an optic, e.g., a refractive lens, reflective lens, planar reflector or transparent planar article, among others. Examples of materials for polishing layer 104 include, for the sake of illustration and not limitation, various polymer plastics, such as a polyurethane, polybutadiene, polycarbonate and polymethylacrylate, among many others.

As seen in FIG. 1, polishing pad 100 typically has a circular disk shape so that polishing surface 108 has a concentric center 116 and a circular outer periphery 120. During use, the article being polished (here, a wafer as indicated by outline 114), which is typically, but not necessarily a semiconductor wafer, sweeps out a circular polishing (wafer) track 124 on polishing surface 108. Polishing track 124 is that portion of polishing surface confronted by the polished article during polishing. Polishing track 124 is generally defined by an inner boundary 124A and an outer boundary 124B. As those skilled in the art will readily appreciate, inner and outer boundaries 124A-B of wafer track 124 are largely circular, but may be considered to be undulated in the case of a polisher that imparts an orbital or oscillatory motion to the polished article and/or polishing pad 100.

Referring to FIGS. 1-3, polishing pad 100 includes a plurality of grooves 128 formed in polishing layer 104 so as to define a groove pattern 132. Each groove 128 may have virtually any cross-sectional shape and cross-sectional size desired to suit a particular set of design criteria. Thus, the rectangular cross-sectional shape of grooves 128, as particularly illustrated in FIG. 2, and the relative cross-sectional size shown are merely illustrative. Those skilled in the art will understand the wide range of shapes and sizes of grooves 128 that a designer may provide to a polishing pad of the present invention, such as pad 100. Those skilled in the art will also readily understand that the cross-sectional shapes and sizes of grooves 128 may vary either along the length of each groove or from groove to groove, or both.

Each groove 128 extends through polishing track 124, crossing both inner boundary 124A and outer boundary 124B. In the embodiment shown, each groove 128 extends from a point proximate concentric center 116 all the way to outer periphery 120 of polishing surface 108. Of course, those skilled in the art will appreciate that the extent of grooves 128 relative to concentric center 116 and outer periphery 120 shown is merely exemplary and non-limiting. For example, some or all of grooves 128 may extend all the way to concentric center 116 and some or all of the grooves may end short of outer periphery 120, as the particular design may accommodate.

Groove pattern 132 is unique among groove patterns in that the angular pitch of grooves 128 varies in a direction that circularly circumscribes concentric center 116 of polishing surface 108 in a predetermined manner. "Angular pitch" as used herein and in the appended claims is defined as the distance between like points, such as points 136A-B, on a pair of immediately adjacent grooves 128 that fall on a circle 140 (FIG. 3) concentric with respect to concentric center 116 as measured by the "pitch angle" a between two straight lines 144A-B that respectively connect points 136A-B to concentric center 116. By predetermined manner, it is meant that the variation in pitch is the result of conscious design choice and not an artifact of, e.g., imprecise manufacturing or misplacement of one or more grooves 128 during the layout or manufacturing of polishing pad 100. In addition, radial pitch is unequal between all adjacent grooves 128 within the wafer track wafer track 124. "Radial pitch" represents the spacing between like features of a groove 128, such as, front sidewall to front sidewall, measured in a radial direction from the concentric center 116 to outer periphery 120. While this concept is very broad and includes such groove patterns as patterns in which the angular pitch appears to vary randomly among the pattern or varies so that no two variations are the same, the concept will typically, though not necessarily, be implemented so that the variation in angular pitch is repetitive.

For example, as best seen in FIGS. 1 and 3, groove pattern 132 is defined by fifteen grooves 128 having a spiral shape and angular pitch that cycle in succession through three differing pitch angles $\alpha$, $\beta$, $\gamma$ around the entire 360° sweep of polishing pad 100 about concentric center 116. The spiral shape of each groove 128 may be laid out as disclosed in the Muldowney patent discussed above in the Background section. While grooves 128 are shown as having a spiral shape, the grooves can have other shapes, such as the piecewise radial-curved-radial shape shown in FIGS. 6 and 7 and the piecewise radial-curved shape shown in FIGS. 8 and 9.

In the embodiment shown and for the diameter of circle 140 illustrated, $\alpha=13°$, $\beta=26°$ and $\gamma=39°$. Since $\gamma$ is significantly greater than either $\alpha$ and $\beta$, human perception tends to group fifteen grooves 128 into five sets 148 of three grooves each. When grouped into sets 148 in this manner, i.e., wherein the largest pitch angle of all of the repeating pitch angles (or larger pitch angle when only two pitch angles are at issue) separates the sets, the variable angular pitch includes one or more intra-set pitch angles (in this case two, pitch angles $\alpha$ and $\beta$) and the inter-set pitch angle (in this case pitch angle $\gamma$). In the embodiment shown, the like intra-set pitch angles $\alpha$, $\beta$ of the five sets 148 are identical to one another, and the five occurrences of inter-set pitch angle $\gamma$ are similarly identical to one another. It is noted that in alternative embodiments, this need not be so. That is, any one or more of pitch angles $\alpha$, $\beta$, $\gamma$ may vary among sets 148 and as between any two adjacent sets. Generally, all that is required to maintain the visually distinct sets 148 of three grooves 128 is that pitch angle $\gamma$ be sufficiently greater than each of pitch angles $\gamma$ so that the three grooves in each set appear to be grouped with one another. Increasing pitch angles $\gamma$ also increases the radial pitch or spacing between adjacent grooves 128. This increase in radial pitch or spacing also serves to separate sets 148.

Figure 4:
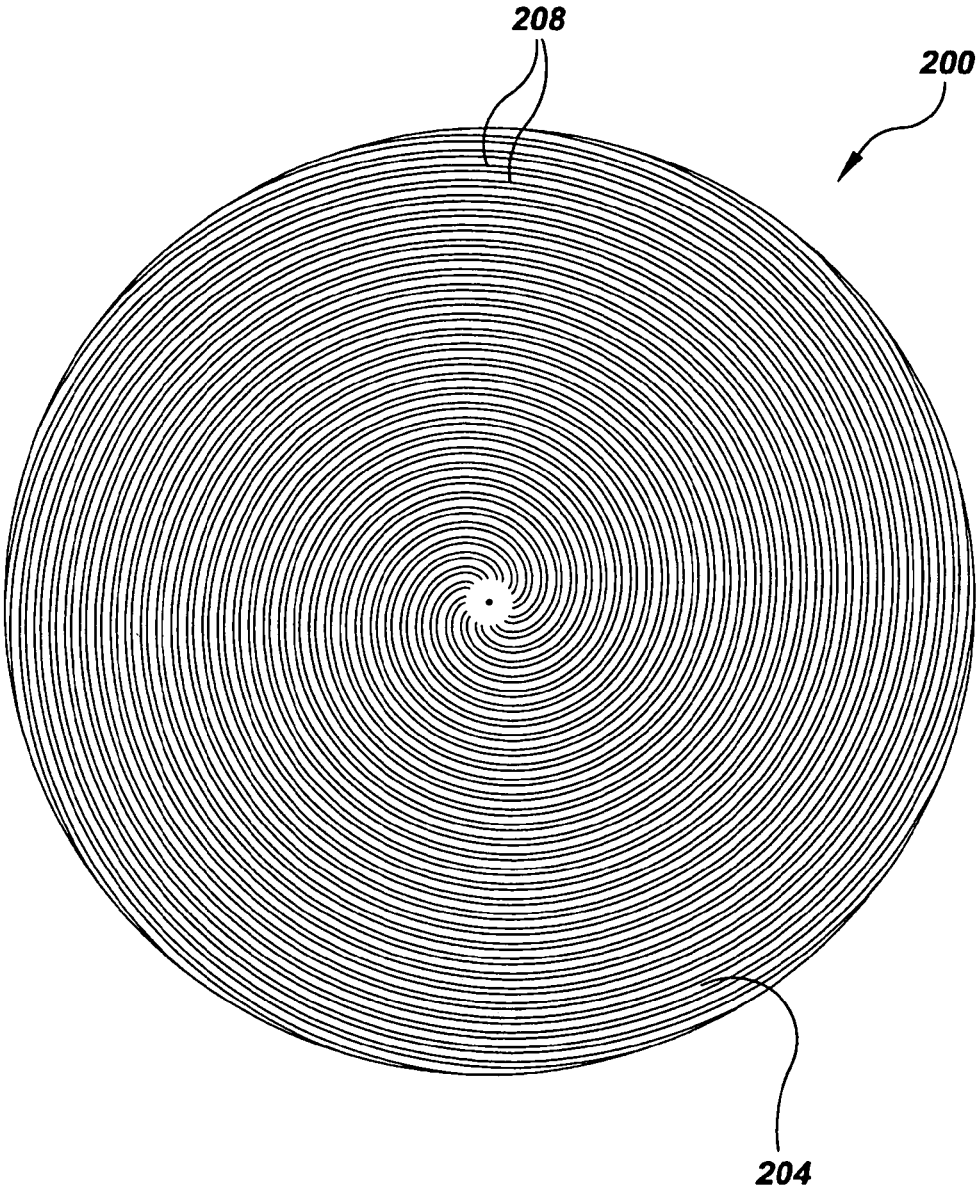
FIG. 4 is a plan view of an alternative polishing pad made in accordance with the present invention.
Figure 5:
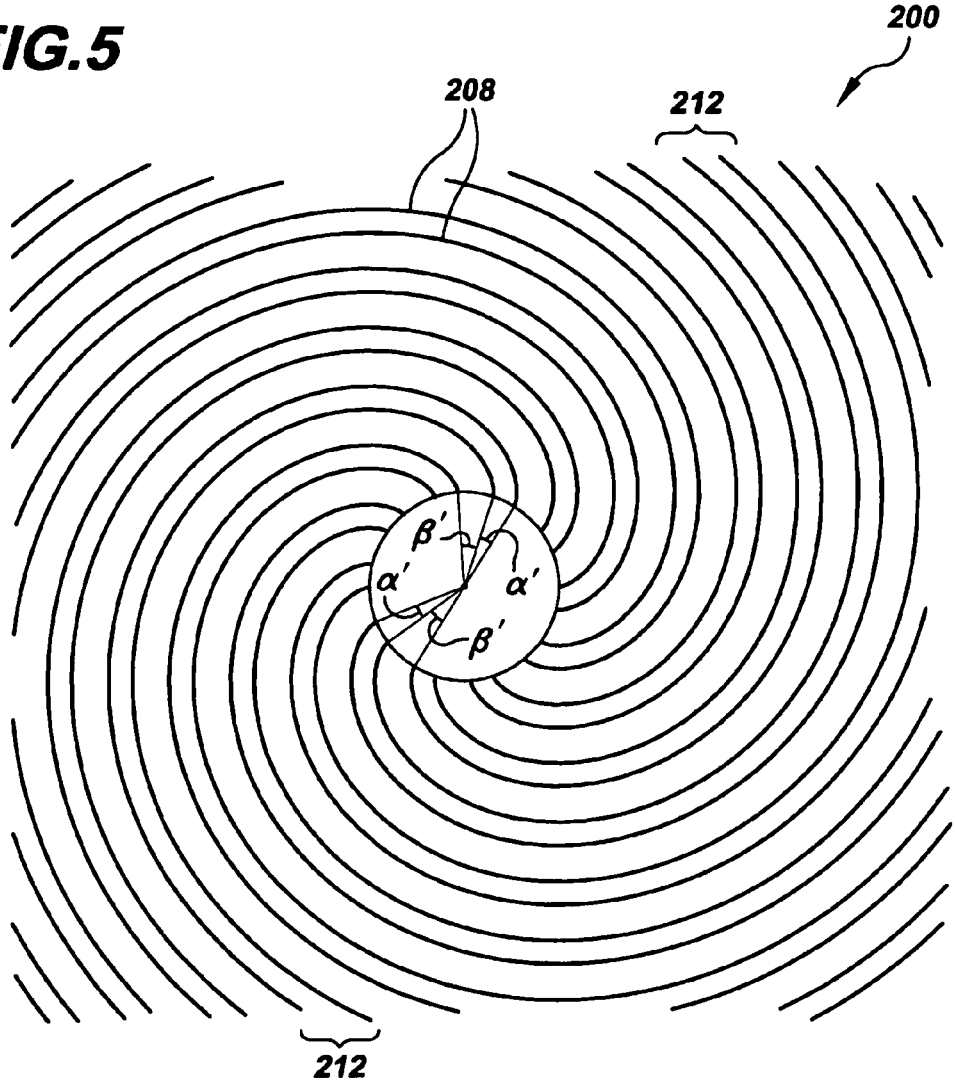
FIG. 5 is an enlarged plan view of the polishing pad of FIG. 4 showing a central portion of the pad.

FIGS. 4-9 illustrated alternative polishing pads 200, 300, 400 made in accordance with the general principles discussed above relative to polishing pad 100 of FIGS. 1-3. More particularly, FIGS. 4 and 5 illustrates polishing pad 200 as including a polishing surface 204 having twenty grooves 208 having an angular pitch that alternates between a pitch angle $\alpha'=14°$ and a pitch angle $\beta'=22°$. This variable pitch gives the visual impression of ten sets 212 of grooves 208 containing two grooves each spaced by intra-set pitch angle $\alpha'$. Correspondingly, each set 212 of two such grooves 208 is spaced by inter-set pitch angle $\beta'$. Like grooves 128 of FIGS. 1-3, each groove 208 of FIGS. 4 and 5 has a spiral shape. Not particularly shown, each groove 208 may also be like grooves 128 of FIGS. 1-3 in terms of cross-sectional shape and size. Relative to polishing pad 200 illustrated in FIGS. 4 and 5, it is noted that an actual sample of this pad showed a 14% improvement in removal rate and a 54% defect reduction when compared to a conventional IC1010™ polishing pad (available from Rohm and Haas Electronic Materials CMP Technologies, Phoenix, Ariz.) made of the same material but having a groove pattern with a constant angular and radial pitch.

Figure 6:
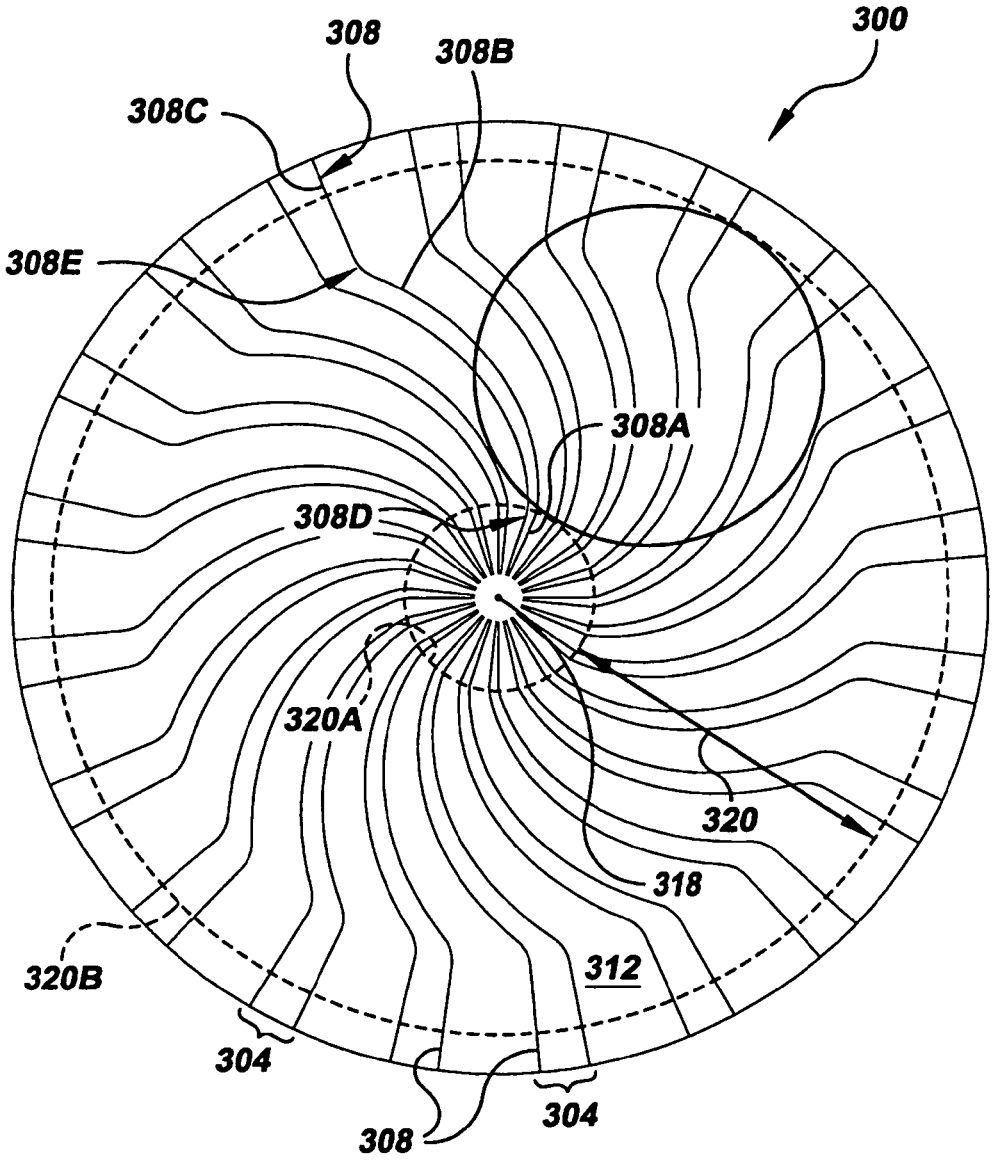
FIG. 6 is a plan view of another alternative polishing pad made in accordance with the present invention.
Figure 7:
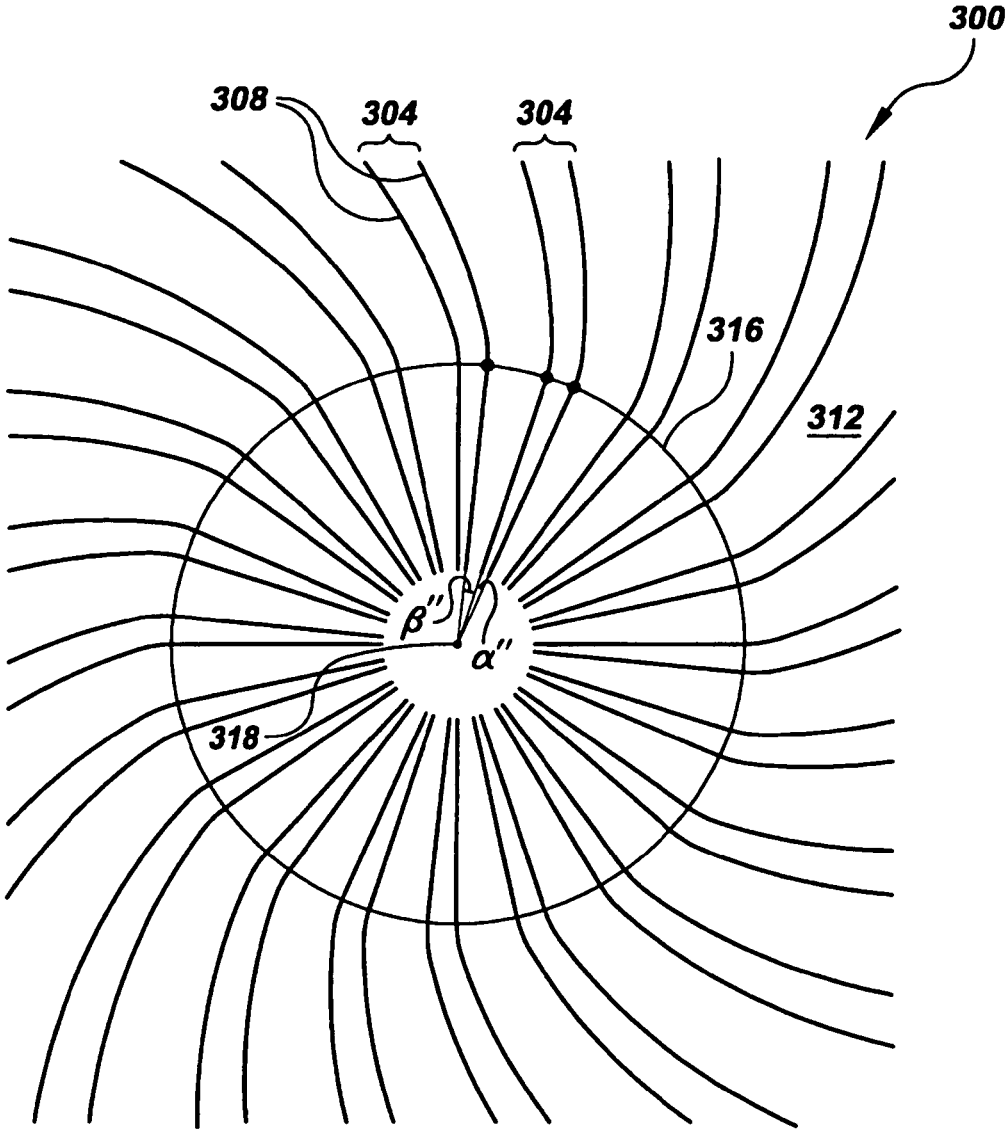
FIG. 7 is an enlarged plan view of the polishing pad of FIG. 6 showing a central portion of the pad.

While polishing pads 100, 200 of FIGS. 1-5 include grooves 128, 208 having spiral shapes, as mentioned above, a polishing pad of the present invention is not required to have spiral grooves. Although each of the grooves 128, 208 have a constant angular pitch through the wafer track, it is possible that the angular pitch may vary within the wafer track. FIGS. 6-9 illustrate two of the many alternatives to spiral grooves. In particular, FIGS. 6 and 7 show polishing pad 300 as having twenty pairs (sets) 304 of grooves 308 distributed evenly around the polishing surface 312. At the location of circle 316, which is concentric with polishing pad center 318, the intra-set pitch angle $\alpha''$ between grooves 308 within each pair 304 is about 5.3° and the inter-set pitch angle $\beta''$ between immediately adjacent grooves of immediately adjacent pairs is about 12.70°. Each of these pitch angles ($\alpha''$, $\beta''$ is repeated twenty times around circle 316 so as to provide the even spacing within and between the twenty pairs 304 of grooves 308.

In this example, as seen in FIG. 6, each groove 308 includes a first straight radial segment 308A, a second straight radial segment 308C and a spiral segment 308B connected to each of the first and second radial segments via a corresponding transition 308D-E. Each groove 308 extends across wafer track 320 and crosses each of inner and outer boundaries 320A-B of the wafer track.

Figure 8:
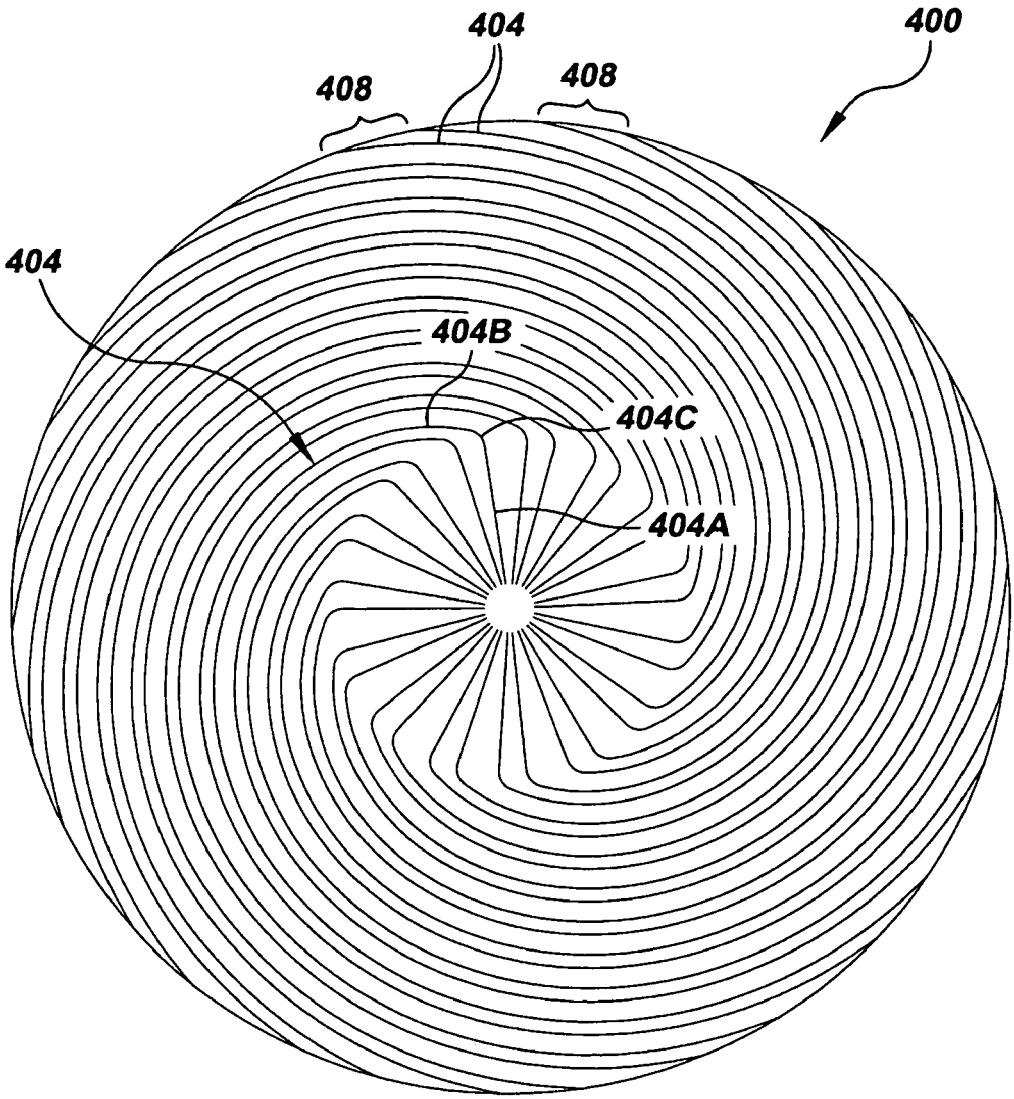
FIG. 8 is a plan view of yet another alternative polishing pad made in accordance with the present invention.
Figure 9:
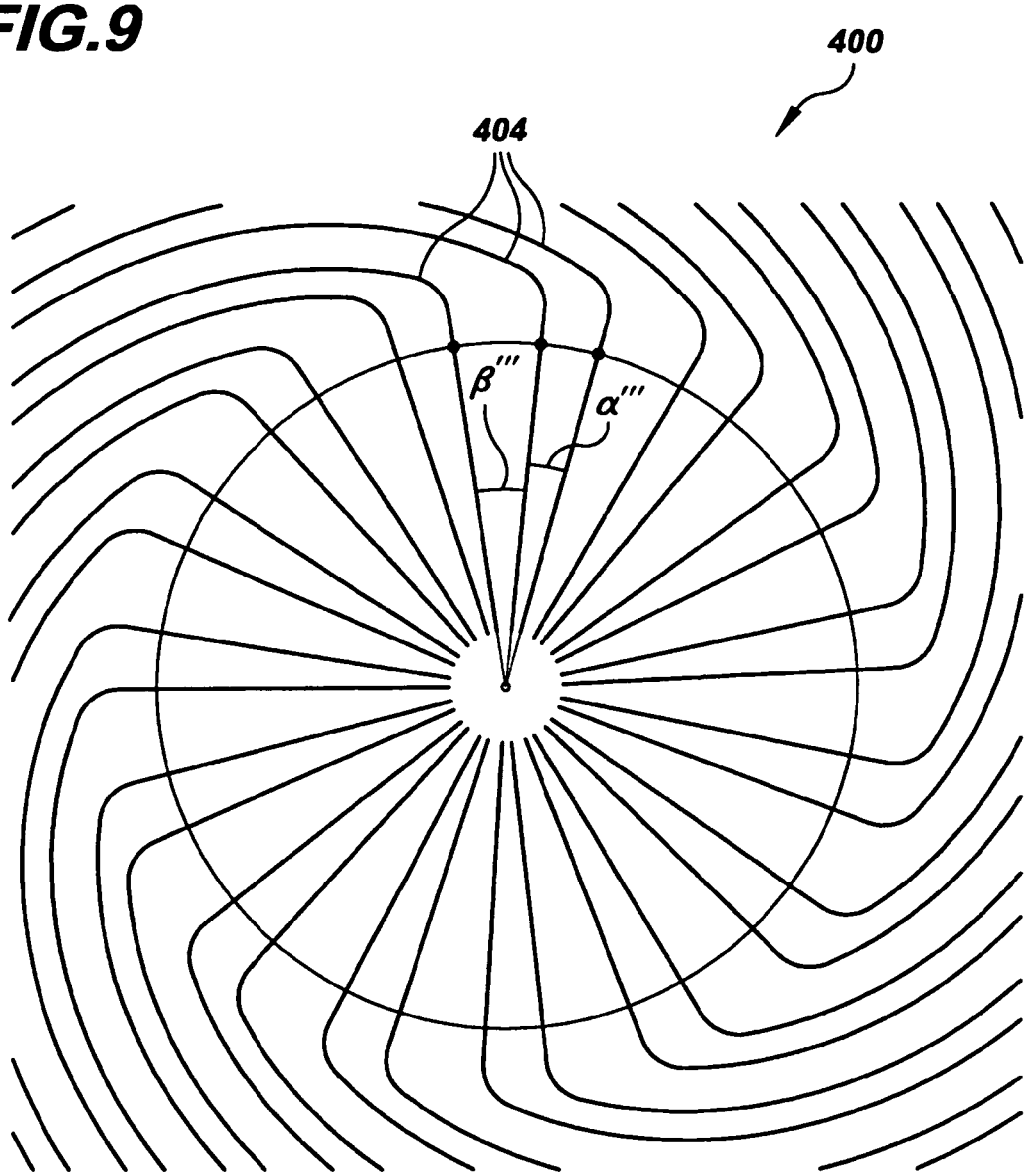
FIG. 9 is an enlarged plan view of the polishing pad of FIG. 8 showing a central portion of the pad.

FIGS. 8 and 9 illustrate yet another polishing pad 400 made in accordance with the present disclosure. Polishing pad 400 is generally similar to polishing pad 300 of FIGS. 6 and 7 in that the grooves 404 are alternatingly separated by an intra-set pitch angle $\alpha'''$ (FIG. 9) and an inter-set pitch angle $\beta'''$ that are each repeated fifteen times around polishing pad 400 so as to visually define fifteen pairs (sets) 408 of grooves 404. In this embodiment, each groove 404 includes a straight radial segment 404A and a spiral segment 404B connected together by a transition segment 404C and intra-set pitch angle $\alpha'''$ is about 9° and inter-set pitch angle $\beta'''$ is about 15°.

Figure 10:
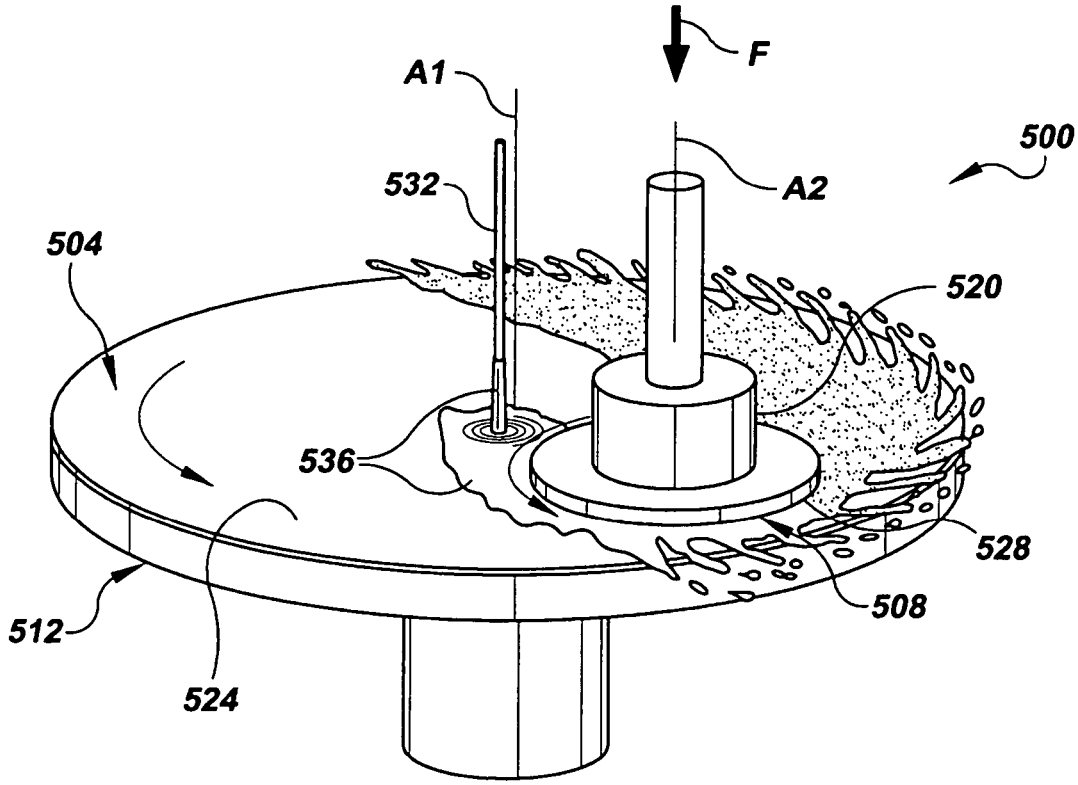
FIG. 10 is a schematic diagram of a polishing system in accordance with the present invention.

FIG. 10 illustrates a polisher 500 suitable for use with a polishing pad 504, which may be one of polishing pads 100, 200, 300, 400 of FIGS. 1-9 or other polishing pad of the present invention, for polishing an article, such as a wafer 508. Polisher 500 may include a platen 512 on which polishing pad 504 is mounted. Platen 512 is rotatable about a rotational axis A1 by a platen driver (not shown). Polisher 500 may further include a wafer carrier 520 that is rotatable about a rotational axis A2 parallel to, and spaced from, rotational axis A1 of platen 512 and supports wafer 508 during polishing. Wafer carrier 520 may feature a gimbaled linkage (not shown) that allows wafer 508 to assume an aspect very slightly non-parallel to the polishing surface 524 of polishing pad 504, in which case rotational axes A1, A2 may be very slightly askew relative to each other. Wafer 508 includes a polished surface 528 that faces polishing surface 524 and is planarized during polishing. Wafer carrier 520 may be supported by a carrier support assembly (not shown) adapted to rotate wafer 508 and provide a downward force F to press polished surface 524 against polishing pad 504 so that a desired pressure exists between the polished surface and the pad during polishing. Polisher 500 may also include a polishing medium inlet 532 for supplying a polishing medium 536 to polishing surface 524.

As those skilled in the art will appreciate, polisher 500 may include other components (not shown) such as a system controller, polishing medium storage and dispensing system, heating system, rinsing system and various controls for controlling various aspects of the polishing process, such as: (1) speed controllers and selectors for one or both of the rotational rates of wafer 508 and polishing pad 504; (2) controllers and selectors for varying the rate and location of delivery of polishing medium 536 to the pad; (3) controllers and selectors for controlling the magnitude of force F applied between the wafer and polishing pad, and (4) controllers, actuators and selectors for controlling the location of rotational axis A2 of the wafer relative to rotational axis A1 of the pad, among others. Those skilled in the art will understand how these components are constructed and implemented such that a detailed explanation of them is not necessary for those skilled in the art to understand and practice the present invention.

During polishing, polishing pad 504 and wafer 508 are rotated about their respective rotational axes A1, A2 and polishing medium 536 is dispensed from polishing medium inlet 532 onto the rotating polishing pad. Polishing medium 536 spreads out over polishing surface 524, including the gap between wafer 508 and polishing pad 504. Polishing pad 504 and wafer 508 are typically, but not necessarily, rotated at selected speeds of 0.1 rpm to 150 rpm. Force F is typically, but not necessarily, of a magnitude selected to induce a desired pressure of 0.1 psi to 15 psi (6.9 to 103 kPa) between wafer 508 and polishing pad 504.

The plurality of grooves having varied angular pitch and unequal spacing in a radial direction can serve to increase polishing removal rate in comparison to polishing pads with equivalent sized, but equally spaced grooves. Furthermore, repeating these grooves as a series of repeating groove sets within the wafer track serves to facilitate polishing uniformity within the wafer. Preferably, the wafer track includes at least three sets of grooves with the grooves having varied radial pitch within the groove set.

The invention claimed is:

1. A polishing pad, comprising:

a) a polishing layer configured for polishing at least one of a magnetic, optical and semiconductor substrate in the presence of a polishing medium, the polishing layer including a polishing surface having a concentric center, a wafer track defined thereon during polishing of a wafer and an outer periphery, the wafer track having an inner boundary and an outer boundary spaced from the inner boundary;

b) a plurality of grooves located in the polishing surface, each groove of the plurality of grooves extending through the wafer track so as to cross each of the inner boundary and the outer boundary, the plurality of grooves having an angular pitch that varies in a predetermined manner where radial pitch between grooves measured in a radial direction from the concentric center to the outer periphery is unequal for all adjacent grooves within the wafer track; and c) a plurality of groove sets in the wafer track, each of the plurality of groove sets being formed by the plurality of grooves, having at least one intra-set pitch angle and having adjacent inter-set pitch angles, at least some of the inter-set pitch angles differing from the at least one intra-set pitch of at least some of the plurality of groove sets.

2. The polishing pad according to claim 1, wherein the at least one intra-set pitch angle is substantially the same across the plurality of sets.

3. The polishing pad according to claim 2, wherein the inter-set pitch angles are substantially identical to one another.

4. The polishing pad according to claim 1, wherein the plurality of grooves are arranged into a plurality of groove sets each having a plurality of intra-set pitch angles that differ from one another.

5. The polishing pad according to claim 4, wherein the plurality of intra-set pitch angles are repeated among the plurality of groove sets.

6. The polishing pad according to claim 1, wherein each of the plurality of grooves defines a spiral curve with a constant angular pitch within the wafer track.

7. A polishing pad, comprising:

a) a polishing layer configured for polishing at least one of a magnetic, optical and semiconductor substrate in the presence of a polishing medium, the polishing layer including a polishing surface having a concentric center, a wafer track defined thereon during polishing of a wafer and an outer periphery, the wafer track having an inner boundary and an outer boundary spaced from the inner boundary;

b) a plurality of grooves located in the polishing surface, each groove of the plurality of grooves extending through the wafer track so as to cross each of the inner boundary and the outer boundary, the plurality of grooves having an angular pitch that varies in a predetermined manner where radial pitch between grooves measured in a radial direction from the concentric center to the outer periphery is unequal for all adjacent grooves within the wafer track; and c) a plurality of groove sets in the wafer track, each of the plurality of groove sets being formed by at least three grooves and having at least one intra-set pitch angle, and the wafer track includes at least three groove sets.

8. The polishing pad according to claim 7, wherein the at least one intra-set pitch angle has a value that is repeated for each of the plurality of groove sets.

9. The polishing pad according to claim 7 wherein each of the plurality of grooves defines a spiral curve with a constant angular pitch within the wafer track.

* * * * *